United States Patent [19]

Lenz

[11] 4,381,700

[45] May 3, 1983

[54] STEPLESS INFINITE VARIABLE SPEED MOTOR

[76] Inventor: Leonard L. Lenz, 811 SE. 10th St., Okeechobee, Fla. 33472

[21] Appl. No.: 182,851

[22] Filed: Sep. 2, 1980

[51] Int. Cl.[3] ..... F01B 13/06

[52] U.S. Cl. ..... 91/497; 417/221; 92/12.1

[58] Field of Search ..... 91/497, 491; 417/221; 92/12.1, 72

[56] References Cited

U.S. PATENT DOCUMENTS

| | | | |
|---|---|---|---|
| 2,929,334 | 3/1960 | Panhard | 91/497 |
| 3,165,069 | 1/1965 | Adamek | 91/497 |
| 3,338,168 | 8/1967 | Davis | 417/462 |
| 4,195,553 | 4/1980 | Klie | 91/497 |

*Primary Examiner*—William L. Freeh

*Attorney, Agent, or Firm*—Ronald E. Barry

[57] ABSTRACT

A fluid actuated device for driving a shaft at variable speed-torque ratios, said device including a casing, a shaft mounted for rotary motion in said casing, a radial piston drive assembly in said casing connected to said shaft, a plurality of pistons mounted for radial motion in said assembly, a plurality of pairs of cam elements positioned in said casing to define cycles of motion for said pistons and a cam lifter ring positioned to control the position of said cam elements, the position of said cam elements determining the operating speed-torque available at the shaft.

25 Claims, 5 Drawing Figures

STEPLESS INFINITE VARIABLE SPEED MOTOR

BACKGROUND OF THE INVENTION

In my U.S. Pat. No. 4,136,602 issued on Jan. 30, 1979 and entitled "Hydraulic Motor" a low speed high torque motor was described which included a drive assembly having a plurality of fluid driven pistons and a pair of cam riders mounted on each piston and positioned to engage a cam surface having a predetermined or fixed cam configuration. The fixed cam surface determined the speed and torque of the motor depending upon fluid pressures. Variations in speed-torque being achieved by varying the fluid pressure. If a different speed-torque characteristic was required at a predetermined fluid pressure, the fixed cams had to be changed.

SUMMARY OF THE INVENTION

The variable torque-variable speed drive device according to the present invention provides a range of speed-torque characteristics at a constant fluid pressure. Variations both in speed and torque can be achieved by utilizing a variable cam to control the operating stroke of the pistons in the drive member. Starting at zero speed and high torque, the speed of the device can be increased to a maximum speed-low torque without any gear change. An extremely high torque is available at start up and decreases as speed increases. The wide range of speed and torque available in this device and the improved performance and operating economy of the device makes it applicable to hundreds of applications. The device can be run in forward or reverse and is free-wheeling. Since it is a sealed system, it can be run in hazardous explosive atmospheres as well as submerged. Because of its small size and weight, it can be coupled directly to the equipment to be driven eliminating the need for gear boxes, reducers and other costly components. When used as a wheel motor it serves as the axle and hub and provides variable speed and torque to each wheel independently. The requirement for a clutch, transmission, drive shafts, universals and differentials is eliminated. It is a highly efficient and economical device for transmitting engine horsepower to the drive wheels of many different types of vehicles.

IN THE DRAWINGS

DETAILED DESCRIPTION

Figure 1:
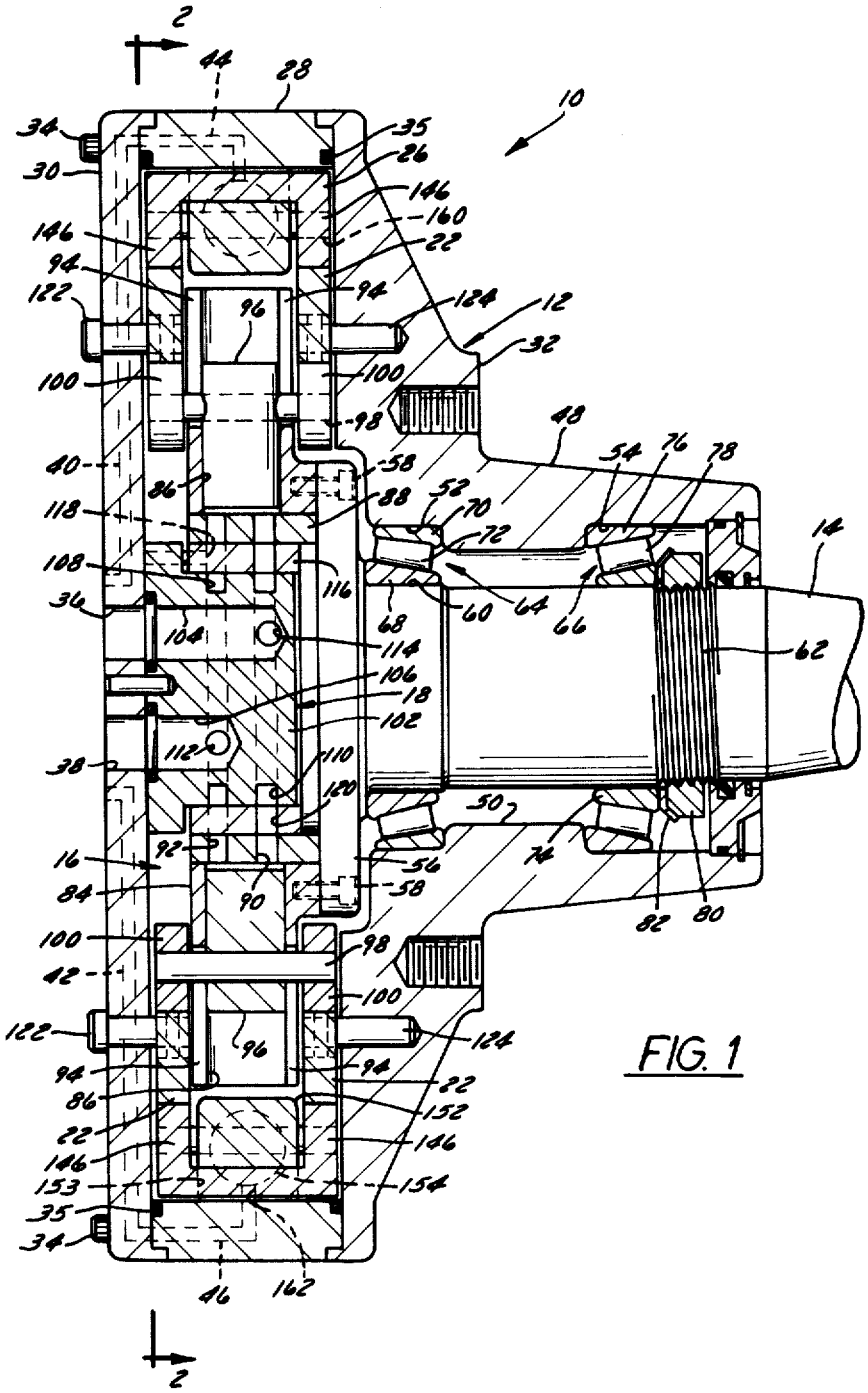
FIG. 1 is a scale view partly in section of the drive device according to the invention.
Figure 2:
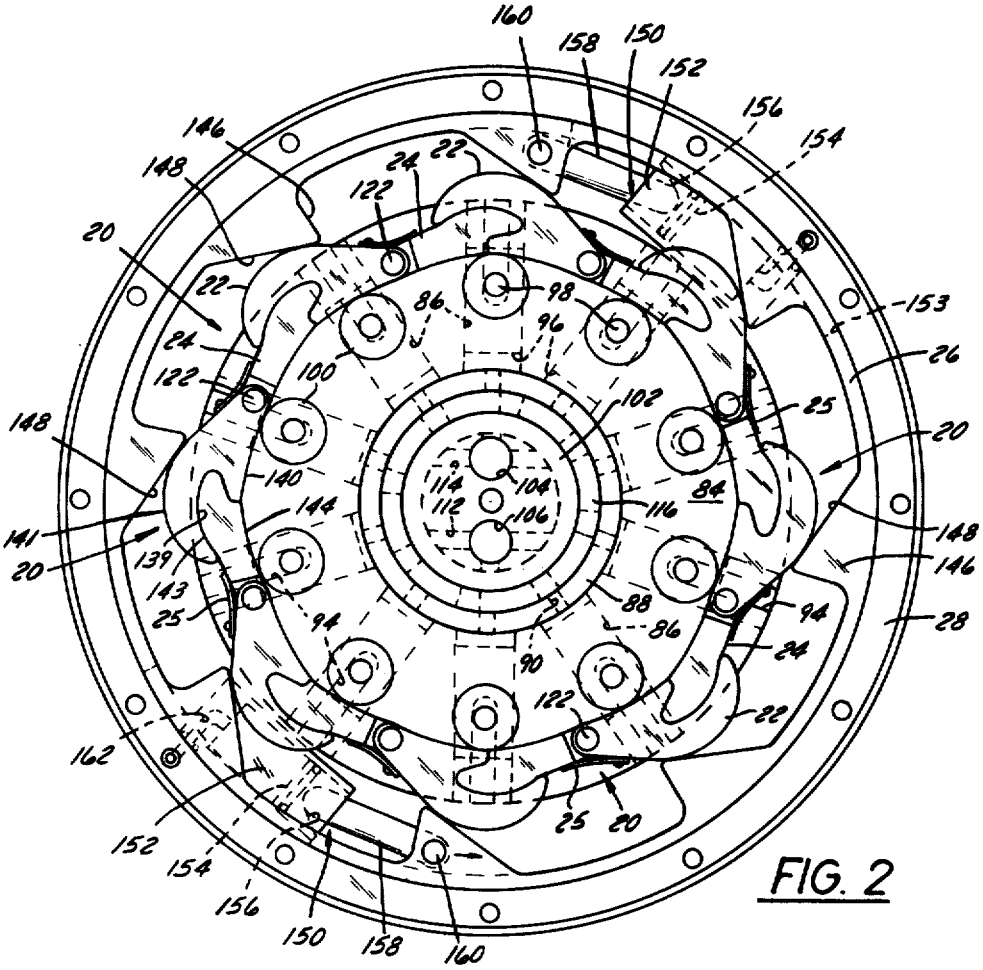
FIG. 2 is a view taken on line 2—2 of FIG. 1 with the rear housing plate removed to show the cam elements in high speed-low torque position.

The variable torque-variable speed fluid motor 10 as shown in FIGS. 1 and 2 generally includes a housing or casing 12 having a shaft 14 mounted for rotary motion in the housing 12. The shaft is driven by means of a radial piston drive assembly 16 located within the housing 12 and connected to the shaft 14. Hydraulic fluid is conducted through a valve core assembly 18 to the radial piston drive member 16 to drive the shaft forward or backward as required. In accordance with the invention the torque and speed of the shaft 14 is controlled by means of a cam ring assembly 20 mounted within the housing 12 radially, outwardly of the piston drive assembly 16.

The cam ring assembly includes a plurality of pairs of cam elements 22 and 24 and a cam lifter ring 26. The cam elements define a continuous cam surface around the outer periphery of the drive assembly 16. The cam elements 22 and 24 are adjustable to vary the cam surface angles and thus the torque imposed on the shaft and as a consequence the speed of rotation of the shaft. Means are provided within the housing for manually or automatically controlling the angular relation of the cam surfaces of elements 22 and 24. Such means is in the form of the cam lifter ring 26 mounted on the inner peripheral surface of the housing 12.

Referring more particularly to FIG. 1, the housing 12 includes a spacer ring 28, a rear housing plate 30, and a front housing plate 32. The spacer ring 28 includes a pair of fluid flow passages 44 and 46. The rear plate and front plate are secured to the spacer ring 28 by means of bolts 34 and sealed thereto by an O ring seal 35. The rear housing plate includes a pair of fluid flow ports 36 and 38 and a pair of fluid flow control passages 40 and 42. The flow passages 40 and 42 communicate with control passages 44 and 46, respectively, provided in the spacer ring 28.

The front housing plate 32 includes a central boss 48 having a central bore 50. A counter bore 52 is provided on the inner end of the bore 50 and a counter bore 54 is provided on the outer end of the bore 50 to provide bearing surfaces at either end of the bore 50 as hereinafter described.

The drive shaft 14 includes a drive plate 56 at the inner end which is connected to the drive assembly 16 by means of screws 58. A bearing surface 60 is provided on the inner end of the drive shaft 14 adjacent to the drive plate 58 and a threaded section 62 is provided at the outer end of the shaft 14.

The drive shaft 14 is supported in the bore 50 of the front plate 32 by means of tapered roller bearing assemblies 64 and 66. The inner tapered roller bearing 64 includes an inner bearing race 68 which is seated on the bearing surface 60 and an outer bearing race 70 which is seated on the bearing surface 52. The roller bearings 72 are positioned between the bearing races 68 and 70. The tapered roller bearing assembly 66 includes an inner bearing race 74 mounted on the outer surface of the shaft 14 and an outer bearing race 76 mounted on the bearing surface 54. The tapered roller bearings 78 being supported between the races 74 and 76.

The shaft 14 is locked into the bearing assemblies 64 and 66 by means of a threaded ring 80 threadedly mounted on the threaded section 62 on the shaft 14. The ring 80 is drawn into snug engagement with the bearing race 74 to set the tapered bearing assembly 64 and 66. The ring 80 is locked in position by means of a lock ring 82 as is generally understood in the art. The shaft 14 is sealed at the outer end by means of a seal ring 190 which is retained in position by a snap ring 192. O-ring seals 194 are provided in grooves 196 in the seal ring 190.

The shaft 14 is driven by means of the radial piston drive assembly 16 which is secured to the drive plate 56 by means of the bolts 58. The drive assembly 16 includes a cylinder housing 84 having ten cylinders 86 extending radially, outwardly from the center thereof at equally spaced angular distances. The cylinders 86 terminate at their inner ends at an annular ring 88 which is provided with two rows of ports 90, 92. Each cylinder includes a pair of slots 94 located on opposite sides of the cylinder 86. A piston 96 is positioned in each of the cylinders and is supported therein for axial movement by means of a shaft 98 which extends outwardly through the slots 94 in the housing 84. Cam rollers 100 are mounted for rotary motion on the ends of the shafts 98.

The pistons 96 are forced radially outwardly in the cylinders by means of hydraulic fluid admitted through ports 92 and 90 which is controlled by means of the valve core assembly 18. In this regard, the valve core assembly 18 includes a hub 102 having a pair of blind bores 104 and 106 which are aligned with ports 36 and 38, respectively, provided in the housing wall 30. Annular grooves 108 and 110 are provided on the outer periphery of the hub 102. Groove 108 is connected to bore 106 by ports 112. Groove 110 is connected to bore 104 by ports 114. Hydraulic fluid to drive the drive assembly 16 can be provided by means of a conventional hydraulic fluid flow circuit including a reversing valve as shown in U.S. Pat. No. 4,915,553 issued on Apr. 1, 1980 and entitled, Fluid Displacement Radial Piston Machine.

The control of fluid flow into and out of the cylinders is provided by means of a flow control ring 116 mounted on the outer periphery of the hub 102. The flow control ring 116 includes two rows of ports 118 and 120. The ports 118 providing communication between the annular groove 108 and the port 92. The ports 120 providing communication between the annular groove 110 and the ports 90. Ports 120 are staggered or offset from the ports 118. Fluid communication is provided to two diametrically opposed pistons 96 which are moving through bottom dead center in the cylinders in the housing 84. Normally, the two cylinders adjacent to the cylinders which are at bottom dead center, depending on the direction of rotation, are also under pressure so that four pistons are acting on the cams at all times. The operation of the radial piston drive assembly is basically the same as described in my earlier U.S. Pat. No. 4,136,602.

In accordance with the invention, means are provided for varying the stroke of the pistons 96 in order to vary the torque and speed of the shaft 14. Such means is in the form of the cam ring assemblies 20 provided on each side of the housing 84 of the drive assembly 16. Each cam ring assembly includes a number of pairs of cam elements 22 and 24 pivotally mounted on pins 122 and 124. The position of cam elements 22 and 24 is controlled by means of a cam lifter ring 26.

Figure 4:
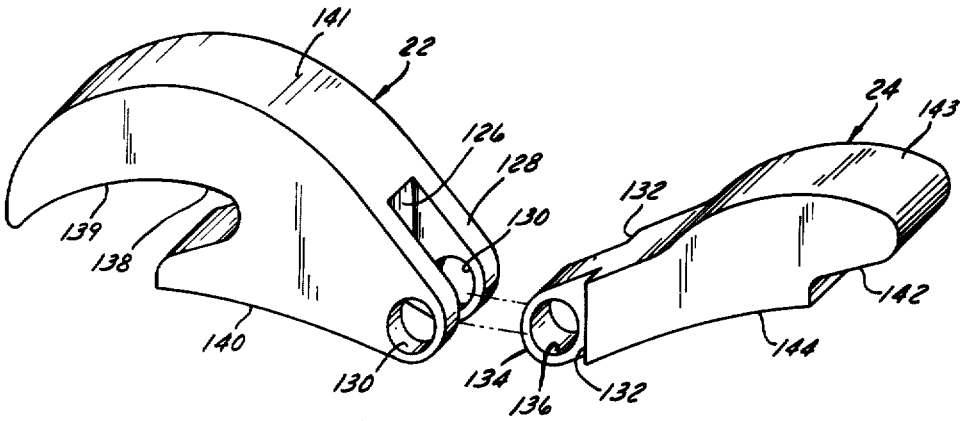
FIG. 4 is an enlarged perspective view of one pair of cam elements.

In this regard and referring to FIGS. 2 and 4, the cam element 22 includes a slot or groove 126 which defines a pair of pivot arms 128. An opening 130 is provided in each of the arms 128. The cam element 24 includes a notch 132 on each side of the element to define a single leg 134 having an opening 136. The leg 136 fits in the groove 126 between the legs 128 with the openings 136 aligned with the openings 130 so that the elements can be mounted on one of the pins 122 or 124. The first element 22 is provided with an elliptical slot 138 having a cam surface 139. An inner cam surface 140 and an outer cam surface 141 are provided on the surfaces of the element 22. The element 24 is provided with an elliptical section 142 having a second cam surface 143. An inner cam surface 144 on element 24 cooperates with cam surface 40 to define a cycle of motion for each piston. The cam surface 143 on the elliptical section 142 is shaped to matingly engage the cam surface 139 in elliptical slot 138 provided in the element 22.

Figure 3:
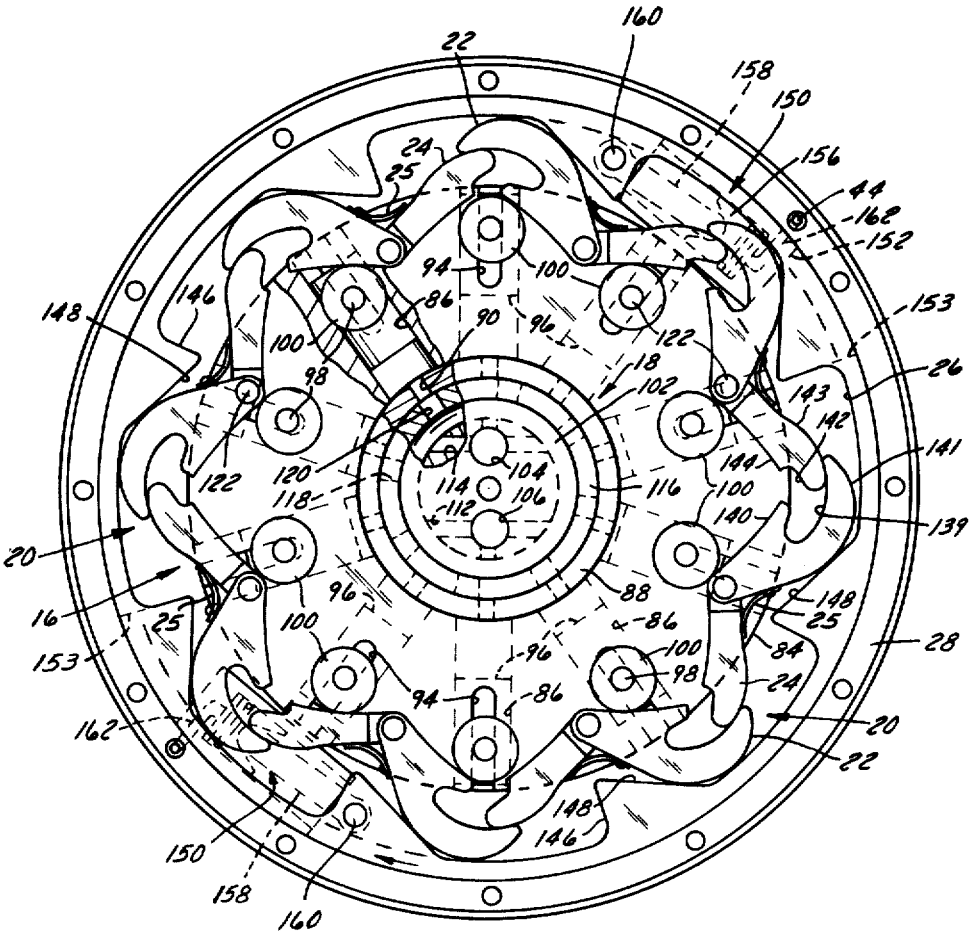
FIG. 3 is a view similar to FIG. 2 showing the cam elements in the low speed-high torque position.

Referring to FIG. 2, when the elements 22 and 24 are pivoted into interengaging relation with the eliptical section 142 seated in the slot 138, the cam surfaces 140 and 144 are positioned in a substantially circular configuration. A slight angular relation exists between the surfaces 140 and 144 in order to achieve movement of the drive member when fluid pressure is applied to the pistons. Referring to FIG. 3, the cam elements 22 and 24 are shown pivoted outwardly to the maximum torque low speed position. High torque at low speed is achieved in this position.

Assuming the drive member 16 is to rotate in a clockwise direction in FIG. 2, the pistons acting on the cam surfaces 140 are pressurized to apply torque to the drive member 16. The cam surfaces 144 are used to return the pistons to their radially inward position. There are eight pairs of cam members and 10 pistons so that each piston moves through 8 cycles of motion in each revolution of the drive member.

Means are provided for moving the cam members radially inward or outward to vary the torque and the speed of rotation of the drive member 16. Such means is in the form of the cam lifter ring 26. As seen in FIGS. 2 and 3, the cam lifter ring is positioned to ride on the inside surface of spacer ring 28. The ring 26 includes a row of cam members 146 on each side. Each cam member 146 including a camming surface 148. Each camming surface 148 being positioned to engage the outer surface 141 of one of the cam elements 22. Each cam element 22 operatively engaging the eliptical section 142 on element 24 to produce an equal and opposite motion in element 24.

The cam elements 22 and 24 are biased by means of a spring 25 to follow the movements of the cam lifter ring 26. In this regard a leaf spring as shown in the drawings or a coil spring can be used to bias the cam elements outwardly.

Figure 5:
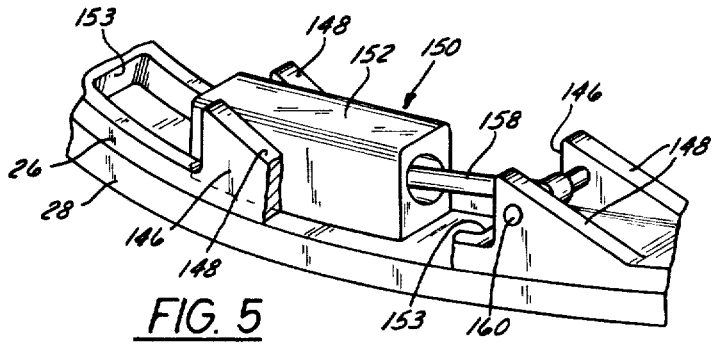
FIG. 5 is a perspective view of a portion of the cam lifter ring assembly shown mounted on the housing.

Means are provided to rotate the cam lifter ring 26 to vary the angular relation of the cam surfaces 140, 144 on cam elements 22 and 24. As seen in FIGS. 2, 3 and 5, such means can be in the form of piston assemblies 150 provided on opposite sides of the spacer ring 28. Each piston assembly 150 includes a housing 152 secured to the spacer ring 28 and having a cylinder 154. The housings 152 are positioned in slots 153 provided in the lifter ring 26. A piston head 156 is provided in each cylinder 154 and is connected to the cam ring 26 by a piston rod 158 and a cross pin 160. The cylinders 154 are connected to the pressure passages 42 and 46 by means of a port 162.

In operation, fluid under pressure is introduced into the cylinders 154 forcing the pistons 156 to move outwardly against the shaft 158 and pin 160. In the absence of any resistance to the movement of the cam lifter ring 26, it will rotate counter-clockwise to the position shown in FIG. 2. The cam elements 22 and 24 will rotate inward until the elliptical section 142 is seated in the elliptical slot 138.

On start-up, fluid under pressure is admitted through either one or the other of the fluid flow ports 36 or 38. The fluid flows through the valve core 18 into two of the oppositely disposed sets of pistons 96 at bottom dead center in the cylinder. If the torque required to rotate the shaft exceeds the torque produced at the cam elements, the cam elements 22 and 24 will be forced to pivot radially outward against the camming surfaces 148 on the cam lifting rings 26. As the force of pistons 96 exceeds the force exerted by pistons 156 on the lifter ring 26, the cam ring 26 will rotate clockwise forcing the piston 156 toward the bottom of the cylinder 154. As the cam ring 26 rotates, the cam elements will also rotate increasing the torque on the cylinder housing which will eventually build up sufficiently to cause the drive assembly 16 and shaft 14 to rotate. As the cylinder housing starts to rotate the piston 96 will move axially in the cylinder. If the fluid enters the valve core through port 36, the return flow from the remaining pistons will be forced back through the valve core assembly to the fluid flow port 38.

The speed of rotation and the torque available from the device will depend on the fluid pressure to the pistons 96. Under normal circumstances, an initial operating pressure will be set for high speed, low torque operation or low speed, high torque operation. The position of the cam elements will vary depending. on the position of the cam lifter ring 26. The position of the cam lifter ring 26 depends on the pressure of fluid in piston assemblies 150. Variations in the speed-torque relation can be adjusted by changing the pressure on the piston assemblies 150.

Although the drive device according to the present invention has been shown and described as having a drive shaft extending from one side only, it is within the contemplation of this invention to run the drive shaft through the casing. With this type of arrangement, the casing can be mounted on any part of the shaft. Since the device is sealed it can also be placed under water.

The embodiments of the invention in which an exclusive property or privilege is claimed, are defined as follows:

1. A fluid actuated device for providing a variable torque-variable speed drive to a shaft, said device comprising a casing, a shaft mounted for rotary motion in said casing, a fluid actuated radial piston drive assembly secured to said shaft and disposed within said casing, said drive assembly including a plurality of pistons to rotate said drive assembly, valve means mounted on said casing for regulating the flow of fluid to said pistons in said drive assembly, and cam means disposed in said casing radially outward from said drive assembly, said cam means including a plurality of variable cam surfaces defining a number of cycles of motion for said pistons whereby the torque and speed of rotation of said drive assembly can be varied.

2. The device according to claim 1 wherein said drive assembly includes a housing having a plurality of radially extending cylinders, one of said pistons being positioned in each of said cylinders for reciprocal radial movement, said cam surfaces varying the radial motion of said pistons.

3. The fluid actuated device according to claim 2 wherein each of said cam surfaces includes a pair of cam elements, each pair of cam elements defining a cycle of radial motion for said pistons.

4. The fluid actuated device according claim 3 wherein said cam means includes a cam lifter ring mounted for rotational movement within said casing and having a cam operatively positioned to control the position of each pair of cam elements and means for moving said cam ring to change the position of the cam elements.

5. The device according to claim 4 wherein said moving means comprises a hydraulic piston and cylinder assembly.

6. The device according to claim 3, 4, or 5 wherein said cam elements include interengaging surfaces for providing equal and opposite movements to said cam elements in response to the movement of said cam lifter ring.

7. A hydraulic variable torque variable speed drive device comprising a casing, a drive shaft mounted for rotary motion in said casing, fluid actuated means within said casing for driving said shaft, said fluid actuated means including a plurality of radially movable pistons, fluid valve means for controlling the flow of fluid to said piston in said fluid actuated means, variable cam means in said casing mounted radially outwardly of said fluid actuated means, said means including at least two pair of movable cam elements to define the cycles of radial motion for said pistons in each revolution of said shaft, cam follower means connected to said pistons and operatively positioned to engage said cam elements whereby the radial motion of said pistons is controlled by the position of said variable cam elements.

8. The device according to claim 7 wherein said cam means includes means for changing the position of said cam elements whereby the speed and torque of said drive means is varied.

9. The device according to claims 8 wherein said cam elements have interengaging cam surfaces whereby the movement of one of said elements produces an equal and opposite movement in the other of said element.

10. The device according to claim 8 wherein said changing means includes a cam lifter ring and a hydraulic piston and cylinder assembly operatively connected to control the position of said cam lifter ring, said cam lifter ring including a cam for each pair of cam elements whereby movements of said lifter ring will change the position of said cam elements.

11. A variable speed and variable torque drive device comprising a casing, a radial piston drive assembly mounted for rotary motion in said casing, said assembly including a housing having a plurality of radially arranged cylinders and a piston mounted for reciprocal movement in each of said cylinders, cam means mounted in said casing and located radially outwardly of said drive assembly for controlling the stroke of said pistons, said cam means including a plurality of pairs of cam elements for producing a number of cycles of motion for said pistons in each revolution of said drive assembly, means connected to said pistons and positioned to operatively engage said cam elements, said pistons moving through cycles of radial motion defined by said cam elements and means within said casing for allowing said cam elements to change position whereby the stroke of said pistons can be changed to vary the torque and/or speed of the drive assembly.

12. The device according to claim 11 including a valve core assembly having a pair of fluid passages connected to said drive assembly whereby said drive assembly can be rotated in either direction of rotation.

13. The device according to claim 11 or 12 wherein said cam elements include interengaging surfaces which provide equal and opposite movement of said cam elements.

14. The device according to claim 13 wherein said allowing means includes a cam lifter ring having a plurality of cam members corresponding to the number of pairs of cam elements provided on said cam means, each cam member being positioned to engage one cam element of each pair of cam elements, said other cam element of each pair of cam elements operatively engaging said one cam element whereby said cam elements move in equal and opposite directions.

15. A hydraulically operated drive device for providing variable torque and variable speeds to a drive shaft, said device comprising a casing, a shaft mounted for rotary motion within said casing, a cylinder housing fixed to said shaft, said cylinder housing including a plurality of cylinders formed therein in equally spaced relation to one another and in radially, outwardly extending relation to the axis of the shaft, fluid control valve means mounted on said casing and being in fluid communication with said plurality of cylinders, a piston moveably disposed in each of said plurality of cylinders, each piston being radially moveable in said cylinder, a radially moveable cam assembly mounted in said casing and disposed in substantially outwardly surrounding relation to said cylinder housing, said cam assembly including a plurality of pairs of cam elements which provide a continuous cam surface on each side of said cylinder housing, each pair of cam elements being disposed in adjustable angular relation to one another to define a cycle of motion for said pistons, cam follower means connected to each of said pistons and disposed in moveable riding engagement to said cam elements whereby fluid passing through said valve means into said cylinders causes outward movement of said pistons relative to said cylinders, said cam follower means moving into driving engagement with said cam elements to cause rotation of said housing and shaft, and a cam lifter ring surrounding said cam elements and being operatively connected thereto to allow the cam elements to change position with respect to each other, and means for biasing said cam lifter ring in a direction to move said cam elements between a high speed-low torque position to a low speed-high torque position.

16. The device according to claim 15 wherein each piston is disposed in a diametrically opposed coaxial relation to one other of said pistons relative to the central axis of said housing.

17. The device according to claim 1, 7, 11 or 15 including means for sealing said casing whereby the device can be operated under water.

18. A hydraulic variable torque, variable speed drive device comprising a housing, a shaft mounted for rotary motion relative to said housing, drive means within said housing and connected to drive said shaft, said drive means including a plurality of radially moveable pistons, variable cam means in said housing mounted radially outwardly of said fluid actuated means to define cycles of radial motion for said pistons, said pistons being disposed in diametrically opposed relation to one other of said pistons relative to the axis of said shaft, fluid valve means connected to said housing for simultaneously pressurizing diametrically opposed pairs of pistons, and cam follower means connected to said pistons and operatively positioned to engage said cam means whereby the radial motion of said pistons is controlled by said variable cam means.

19. The drive device according to claim 18, wherein said variable cam means includes a plurality of pairs of cam elements, each pair of cam elements defining a cycle of radial motion for said pistons.

20. The drive device according to claim 19, including means for simultaneously changing the relative position of each of said pairs of elements to change the cycle of radial motion of all of said pistons.

21. The drive device according to claim 19 or 20, wherein said cam elements include means for producing equal and opposite movement of the elements in each pair of elements whereby said drive means can be rotated in either direction.

22. A hydraulic drive device comprising a casing, a drive shaft mounted for rotary motion in said casing, a radial piston drive assembly connected to said shaft and including a cylinder housing having ten cylinders radially arranged around said shaft, and a piston mounted for reciprocal movement in each of said cylinders, variable cam means in said casing disposed radially outwardly of said drive assembly to define eight cycles of radial motion for said pistons in each revolution of said drive assembly, fluid valve means connected to said housing for controlling the flow of fluid to said cylinders, and cam follower means connected to said pistons and positioned to operatively engage said cam means whereby each of said ten pistons moves through eight cycles of motion in each revolution of said drive assembly.

23. The drive device according to claim 22, wherein said pistons are disposed in diametrically opposed relation to one other piston and said fluid valve means is arranged to simultaneously pressurize diametrically opposed pistons whereby the forces acting on said variable cam means are equalized.

24. The drive device according to claims 22 or 23, wherein said cam means includes a pair of cam elements for each cycle of radial motion.

25. The drive device according to claim 24, including a cam lifter ring surrounding said cam elements and being operatively connected thereto to allow the cam elements to change position with respect to each other, and means for biasing said cam lifter ring in a direction to move said cam elements between a high speed, low torque position to a low speed, high torque position.

* * * * *